United States Patent [19]

Peterson

[11] Patent Number: 4,836,231

[45] Date of Patent: Jun. 6, 1989

[54] BEACH SHADE

[76] Inventor: William R. Peterson, 26 Barclay Dr., Turnersville, N.J. 08102

[21] Appl. No.: 173,258

[22] Filed: Mar. 25, 1988

[51] Int. Cl.[4] ..... E04H 15/28

[52] U.S. Cl. ..... 135/98; 135/117; 135/118; 135/20 A

[58] Field of Search ..... 135/16, 98, 99, 20 A, 135/117, 118, 902

[56] References Cited

U.S. PATENT DOCUMENTS

| | | | |
|---|---|---|---|
| 123,380 | 2/1872 | Clarke | 135/98 |
| 300,427 | 6/1884 | Zanger | 135/120 |
| 318,710 | 5/1885 | Egan | 135/98 |
| 553,735 | 1/1896 | Murgatroyd | 135/20 A |
| 706,605 | 8/1902 | Slyder | 135/98 |
| 1,409,609 | 3/1922 | Stockle | 135/99 |
| 1,526,726 | 2/1925 | Townsend | 135/99 |
| 1,538,311 | 5/1925 | Anticknap | 135/118 |
| 1,543,134 | 6/1925 | Todd | 135/118 |
| 1,769,315 | 7/1930 | Schoenhard | 135/20 A |
| 2,130,919 | 9/1938 | Erickson et al. | 135/118 |
| 2,496,501 | 2/1950 | Staimton et al. | 135/98 |
| 2,547,770 | 4/1951 | Pelton | 135/118 |
| 2,559,421 | 7/1951 | Ganett | 135/98 |
| 2,948,289 | 8/1960 | Owczarek | 135/20 A |
| 4,086,931 | 5/1978 | Hall | 135/99 |
| 4,433,699 | 2/1984 | Schultes et al. | 135/117 |

FOREIGN PATENT DOCUMENTS

| | | | |
|---|---|---|---|
| 948421 | 8/1949 | France | 135/20 A |

*Primary Examiner*—David A. Scherbel
*Assistant Examiner*—Caroline D. Dennison
*Attorney, Agent, or Firm*—Paul Maleson

[57] ABSTRACT

A portable, collapsible beach shade for providing protection from the sun, wind, or observation, to a user. The beach shade, when developed, has a plurality of ribs pivoted around a common point at one end. The ribs are covered with flexible sheeting. The fan-like structure is mounted at the top of a pole, adapted to be implanted in the sand or other ground. The user may adjust the position of the planar fan-like structure in several degrees of freedom. The device retains a high degree of stability even when subjected to high and shifting winds under recreational conditions.

3 Claims, 2 Drawing Sheets

BEACH SHADE

FIELD OF THE INVENTION

This invention relates to devices for providing shade from the sun, or other protection, to persons. Generally, such protection is intended for persons in a stationary location outdoors, usually on a beach. It is understood that the utility of the invention is not limited to recreational use on a beach, though that is preferred. More particularly, it relates to a portable, collapsible device having a fan-like planar appearance when deployed, rather than being a type of umbrella.

BACKGROUND OF THE INVENTION AND PRIOR ART

The concept of beach umbrellas is well known. Many such umbrellas, including eccentric mountings and many folding or collapsing means, are found in the patented art. Such prior patents include U.S. Pat. Nos. 3,042,055; 1,126,293; 2,707,476; 229,685; 1,769,315; 2,731,973; 1,589,299; 553,735; 2,948,389; and 3,304,035. Also, fences or fence-like means have a shade-producing and wind potection function.

SUMMARY OF THE INVENTION

The invention comprises a portable, collapsible personal shade, wind, and observation protecting device mainly intended and suitable for persons outdoors or on a beach. It is characterized by presenting a fan-like appearance when deployed. In a preferred embodiment, the user sticks a pole into the sand. The user than opens or deploys the fan-like structure carried on the pole, which comprises ribs pivoting around a common point at one end and covered with a flexible sheet material. The opened structure is planar rather than having the characteristic cup-like shape of an umbrella. The user may set many positional aspects of the fan-like structure, including its angles to both vertical and horizontal. It may be locked in place and is secure against ordinary climate conditions as encounted in recreational use on beaches. It may be adjusted as needed.

DETAILED DESCRIPTION OF THE INVENTION

Figure 1:
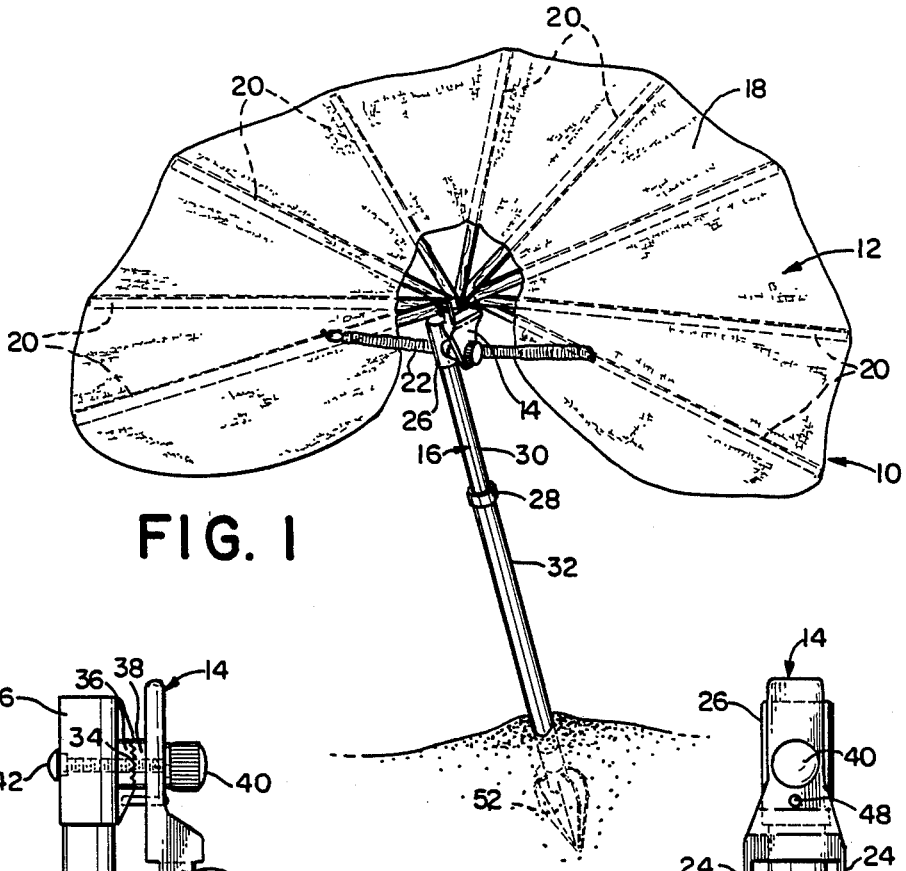
FIG. 1 is a front perspective view of the beach shade in operative position.

The invention may be best initially understood in connection with FIG. 1. This figure shows the beach shade, generally designated 10, installed in operative position in the sand. The ribs 20 are fully deployed and are covered with an attached sheet of fabric 18. The pole, generally designated 16, is thrust into the sand where it is helped to be retained in a stable condition by the ground spike 52. The pole has been implanted in the sand at the desired angle, both with respect to the vertical and the horizontal. The ribs and fabric covering, which together comprise what may be generally designated as a fan or fan-like portion 12, have been set at the desired angle with respect to the pole and have been locked in that position. As shown, the ribs are on the underside of the fabric 18 and are therefor shown in phantom line. The ground spike 52 is buried in the sand and is therefor shown in phantom line.

The pole 16, which is preferably telescopic, that is, selectively extendable, has been extended to the desired length and had been secured or locked there by turning collar 28. In the embodiment shown, pole 16 comprises an upper pole 30 which fits into a lower pole 32. The concept and structure of a telescoping pole with a locking means, as a collar, is well known, as for example in the legs of common photographic tripods, and is not in itself a novel part of this invention.

In FIG. 1, the fan 12 has been locked into the desired attitude by operation of the structure of the pole cap 26. This structure and operation are described in more detail below. Flexible stabilizing bands 22 extend from the pole cap 26 to the edges of the fan 12, as shown, to aid in keeping it fully deployed, even in high winds. It is apparent that all the user choosable settings, as the various angles and lengths as have been described, are chosen with respect to the position of the sun, the direction of the wind, and the intended location of the user on the beach so as to provide the desired shade or other protection. The use of the term fan is to be understood as denoting a suggestive shape, and not as denoting a device having the commonly udnerstood functions of a fan.

Figure 6:
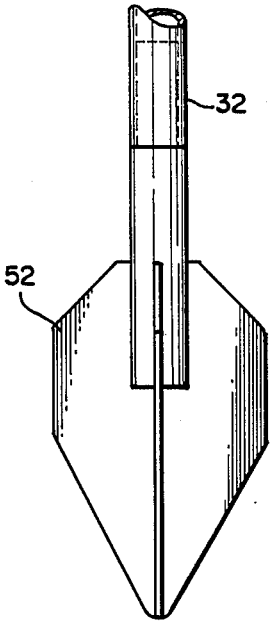
FIG. 6 is a detailed view, partially fragmented, of the bottom or ground spike and of the pole.

While the broad concept of this invention is not limited to the use of particular materials, certain materials have advantages and disadvantages. The ribs 10, if made of white or yellow pine, break cleanly if they break and a broken rib may be replaced. Hickory wood tends to splinter before breaking and is thus less desirable. For the ribs, aluminum tends to bend and cannot be repaird e ily. Plastics tend to be too flexible and floppy to maintain the desired configuration in high wind conditions. The fabric 18 may indeed be a woven cloth, but non-woven material, as common sheet plastics, are also within the scope of this invention. The pole 16 is preferably a hollow metal tube of conventional construction, but it is within the spirit of this invention to provide a pole of wood or other material. The ground spike 52 has been found to add additional stability, particularly in high winds, because its blade faces, as best shown in FIG. 6, bear against the sand and resist movement. The stabilizing bands 22, which may, for example, be cloth or flexible plastic, are an additional measure to aid in preventing the ribs from tending to close, particularly in high winds.

The structure and operation of the main locking means, which generally comprises pole cap 26 and a fan base generally designated 14 and their associated structure is best described in connection with FIGS. 2, 3, 4, and 5. The major portion of pole cap 26, best shown in FIG. 2, may preferably be made a molded plastic. It fits over the top of the upper pole 30. It has a horizontal hole to receive a threaded angle lock bolt 42. It has a vertically oriented inner serrated disk 36. As shown, disk 36 has serrations 34 arranged in a circular pattern around its center.

The fan base 14 interacts with the pole cap 26. At one end, the fan base 14 is provided with a horizontal hole to receive a portion of the angle lock bolt 42. Surrounding this hole is an outer serrated disk 38 provided with face serrations 34. Disk 38 has the same configuration as disk 36 and mates with it by the engagement of their serrations 34 when the disks are brought into contact. An angle lock knob 40 is provided on the end of angle lock bolt 42. When knob 40 is tightened, the serrations 34 engage and the fan base 14 is locked against rotation with respect to pole cap 26.

Figure 4:
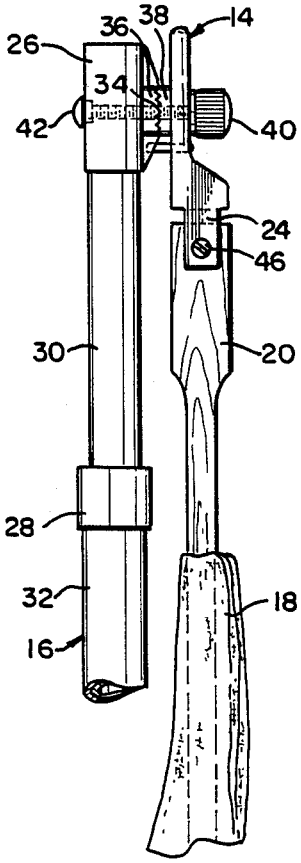
FIG. 4 is a detailed view, partially fragmented, of the top of the pole and its associated structure with the ribs in a down or stored position.
Figure 5:
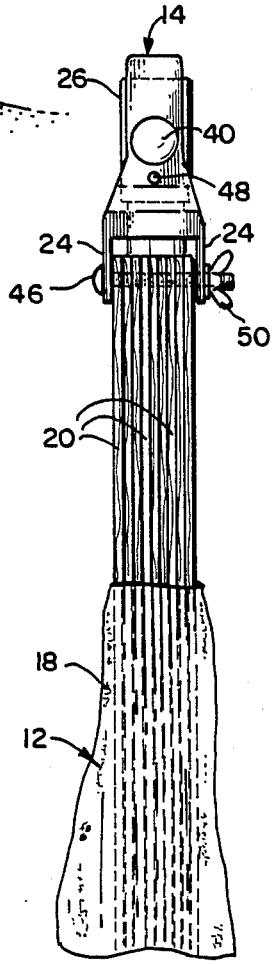
FIG. 5 is a side view of the pole top taken from the right side of FIG. 4.
Figure 2:
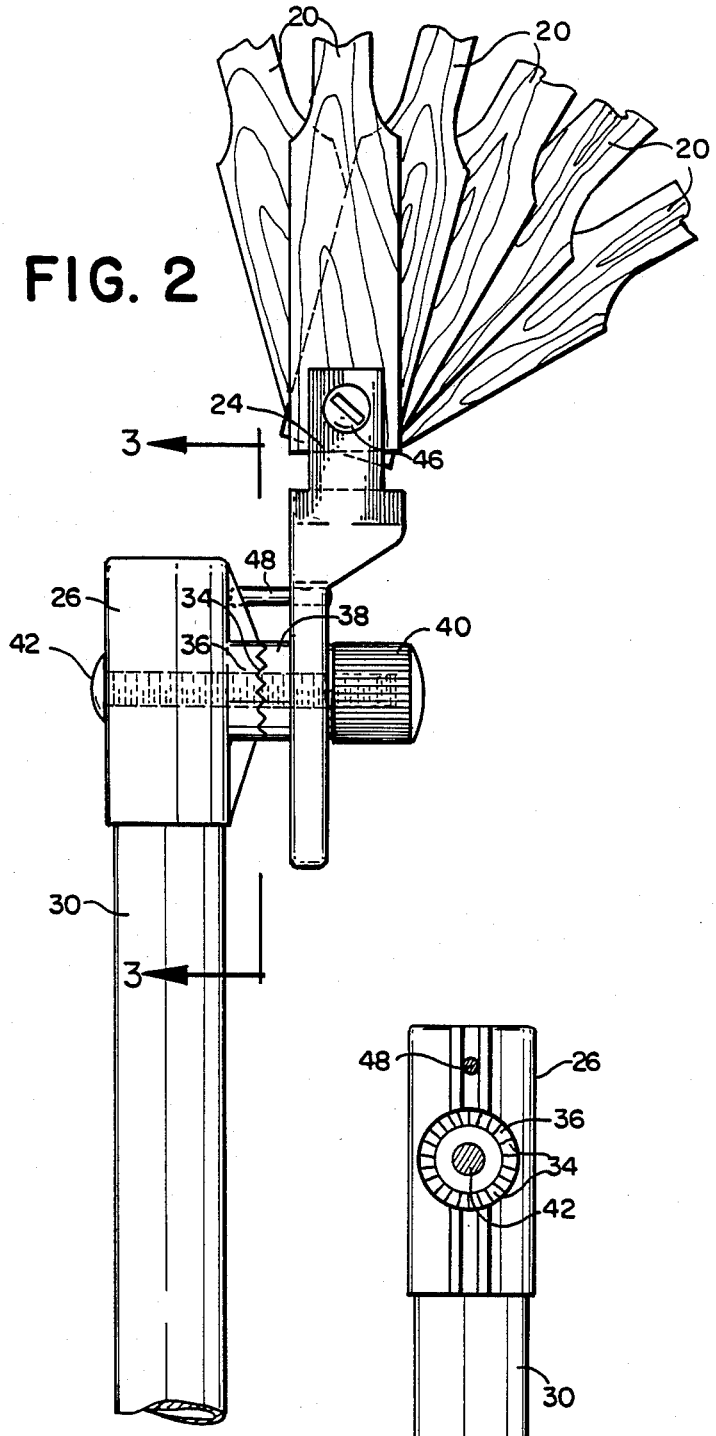
FIG. 2 is a detail view, partially fragmented, of the top of the pole and its associated structure with the ribs partially deployed.
Figure 3:
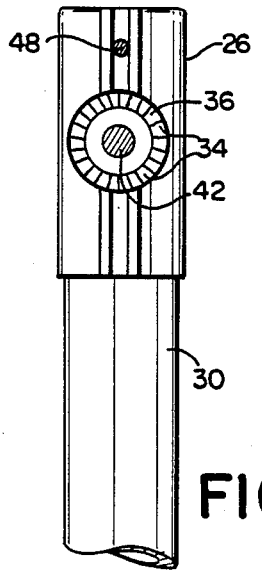
FIG. 3 is a partially fragmented view taken along lines 3—3 of FIG. 2.

As an additional protection against undesired rotation, a stop lug 48 extends from the fan base 14 towards the pole cap 26 and bears against it if the serrations should slip. The other end of the fan base 14 divides into a fork 24. As best shown in FIG. 5, a rib spread lock bolt 46 extends through and across the fork 24 and may be tightened by a rib spread lock wing nut 50. In FIGS. 4 and 5, the device is shown in a partly stored condition, with the ribs collapsed together and the fan swung downward to parallel the pole. It only requires the pole to be telescoped into its most compact position of the entire beach shade 10 to be in a fully stored condition. It is apparent however, that the rib spread lock bolt is also tightened when the ribs 20 are fully deployed and the device is in its operative condition. This tightening, by means of the wing nut or equivalent nut or knob 50, holds the ribs in the deployed state.

The beach shade of this invention provides a relatively compact and light means to give shade or other protection to a beach-goer with more efficiency and stability and less obtrusiveness than previously known expedients. The scope of this invention is governed by the appended claims and is not limited to the embodiment shown and described.

I claim:

1. A beach shade comprising a mounting pole, a user selective deployable and callapsible planar fan-like structure supported on said pole, said fan-like structure supported on said pole by locking means, said locking means being user selective angle adjusting and locking and unlocking, said fan-like structure comprising a plurality of ribs, each of said ribs being pivoted at one end thereof to said locking means, said ribs being covered with a flexible sheet, said locking means comprising a pole cap on one end of said pole and a fan base at said pivoted end of said ribs, said pole cap and said fan base having mutually user selectively engageable means, said engageable means comprising an inner serrated disk on said pole cap and an outer serrated disk on said fan base, and a tightenable angle lock bolt being provided to selectively engage and disengage said disks, said fan base including a fork, said pivoted ends of said ribs being retained within said fork by a ribbed spread lock bolt passing through said fork and said ribs, and a stop lug extending from said fan base and intercepting said pole cap, and flexible retaining bands extending from each side of said pole to an adjacent end of a deployed said fan-like structure to add additional stability to said deployed beach shade.

2. A beach shade as set forth in claim 1 wherein said pole is provided at the bottom end thereof with a ground spike having blades to add additional stability to the implanting of said pole in the ground.

3. A beach shade as set forth in claim 1 wherein said pole comprises an upper pole section and a lower pole section, one of said pole sections fitting into the other, whereby the length of said pole may be telescopically adjusted.

* * * * *